United States Patent [19]

Hess et al.

[11] Patent Number: 4,746,004

[45] Date of Patent: May 24, 1988

[54] DEVICE FOR FORMING SEPARATE BATCHES OF FLAT ELEMENTS RUNNING IN A FLOW

[75] Inventors: Markus Hess, Cheseaux; Jean-Bernard Morisod, Crissier, both of Switzerland

[73] Assignee: Bobst SA, Switzerland

[21] Appl. No.: 928,569

[22] Filed: Nov. 10, 1986

[30] Foreign Application Priority Data

Nov. 11, 1985 [CH] Switzerland ..... 4827/85

[51] Int. Cl.[4] ..... B65H 33/12

[52] U.S. Cl. ..... 198/423; 198/425; 271/202; 271/244; 271/245; 271/270; 377/8; 414/35; 414/43; 414/901

[58] Field of Search ..... 414/28, 29, 35, 43, 414/901; 198/422, 423, 425, 503, 572, 575, 579; 271/202, 243, 244, 245, 270; 377/8

[56] References Cited

U.S. PATENT DOCUMENTS

| | | | |
|---|---|---|---|
| 2,358,283 | 9/1944 | Walter | 198/425 |
| 3,313,221 | 4/1967 | Gübeli | 198/503 |
| 3,596,575 | 8/1971 | Brockmuller | 414/35 |
| 3,724,840 | 4/1973 | Kuckhermann | 271/270 X |
| 3,772,971 | 11/1973 | Dutro et al. | 414/43 X |
| 4,474,521 | 10/1984 | Jaton | 414/31 |

FOREIGN PATENT DOCUMENTS

| | | | |
|---|---|---|---|
| 1071101 | 12/1959 | Fed. Rep. of Germany | 414/35 |
| 138536 | 11/1979 | German Democratic Rep. | 271/202 |
| 646389 | 11/1984 | Switzerland . | |
| 2165676 | 4/1986 | United Kingdom | 377/8 |

*Primary Examiner*—Leslie J. Paperner

*Attorney, Agent, or Firm*—Hill, Van Santen, Steadman & Simpson

[57] ABSTRACT

A device for forming separate batches of flat objects, such as folded box blanks, from a flow of blanks received from a delivery station of a processing machines, such as a folder-gluer, includes a belt conveyor, a counting device, and a movable stop which is movable parallel to the belt surface and also movable vertical to the belt surface with a control device to move the stop in response to sensed conditions. The control device controls a drive arrangement for the belt conveyor so that the speed of the belt conveyor can be driven at a greater rate than the speed of discharge from the delivery station during a selected period for separating the batch of blanks from the remaining flow.

7 Claims, 8 Drawing Sheets

DEVICE FOR FORMING SEPARATE BATCHES OF FLAT ELEMENTS RUNNING IN A FLOW

BACKGROUND OF THE INVENTION

The present invention is directed to a device for forming separate batches of running elements particularly for forming separate batches of folded box blanks being delivered in a flow from a processing machine.

Generally, the forming of batches of folded box blanks, which are delivered in a flow by a delivery station of a folder-gluer, for example, is achieved manually. The folder-gluer is provided with a counting device acting with a device for laterally pulling or offsetting one of the folded boxes so that it exceeds the width of the flow of shingled folded box blanks. Each of the shifted box blanks is easy to locate at the delivery station of the folder-gluer and the operator will form successive batches of folded box blanks by manually separating the blanks each time there is a shifted box blank. This method only works with relative low speeds.

To satisfy the high speed requirements of todays machines, the forming of batches of folded box blanks should be achieved automatically. A device which is disclosed in the Swiss Pat. No. 646,389, issued Nov. 30, 1984, partly meets these requirements. This patent does indeed refer to a station where folded box blanks are delivered in a continuous flow by a delivery station of the folder-gluer to be piled up on a lower jaw of a grip. When detecting means checks the thickness of the batch and if the thickness reaches the value corresponding to the wanted number of folded box blanks for one batch, the detecting means orders its removal. During the removal of the batch, the folded box blanks arriving from the flow are withheld by a comb so that a sufficient gap is created as the upper jaw of the grip removes the batch of box blanks.

A main draw-back of the manual batch forming operation is, of course, the limited speed which is determined by the skill of the operator. The device described above has the advantage of surpassing the manual operation for forming the batches but has the draw-back of requiring when the batches are to be removed the device has a draw-back of requiring a withholding of the folded box blanks arriving in a flow with a comb in a different plane from the one for the batch forming operation. Without even considering the dangers of jamming, this change of planes and the withholding of the folded box blanks requires the use of several complicated and expensive elements.

SUMMARY OF THE INVENTION

The object of the present invention is to overcome the draw-backs and to form separate batches of folded box blanks with simple elements which require no change of the plane for the flow of the folded box blanks during the separating operation.

To accomplish these goals, the present invention is directed to an improvement in a device for forming separate batches of flat objects, particularly for forming batches of folded box blanks being discharged as a flow from a processing machine, said device including a belt conveyor being arranged to receive the discharge from a delivery station of the processing machine, counting means for determining the number of blanks passing therebeneath in the flow of blanks, separating means for removing a batch of counted blanks from the flow of blanks and control means for actuating the separating means. The improvements are that the separating means includes a stop, means mounting the stop adjacent a surface of the conveyor belt for both movement parallel to the belt and perpendicular to this surface, first means for moving the stop between to a first horizontal position adjacent the counting means, second means for moving the stop between a first vertical position adjacent the surface of the belt to a second vertical position raised above the surface of the belt, third means for driving the conveyor belt at a linear speed of a delivery station of the processing machine, fourth means for driving the belt at a speed greater than the linear speed of the delivery station machine, said control means including switch means being engaged when the stop is moved to the first horizontal position, said switch means actuating the fourth means to accelerate the speed of the belt to rapidly remove a batch from beneath the stop.

Other advantages and features of the present invention will be readily apparent from the following description of the preferred embodiments, the drawings and the claims.

DESCRIPTION OF THE PREFERRED EMBODIMENTS

Figure 1:
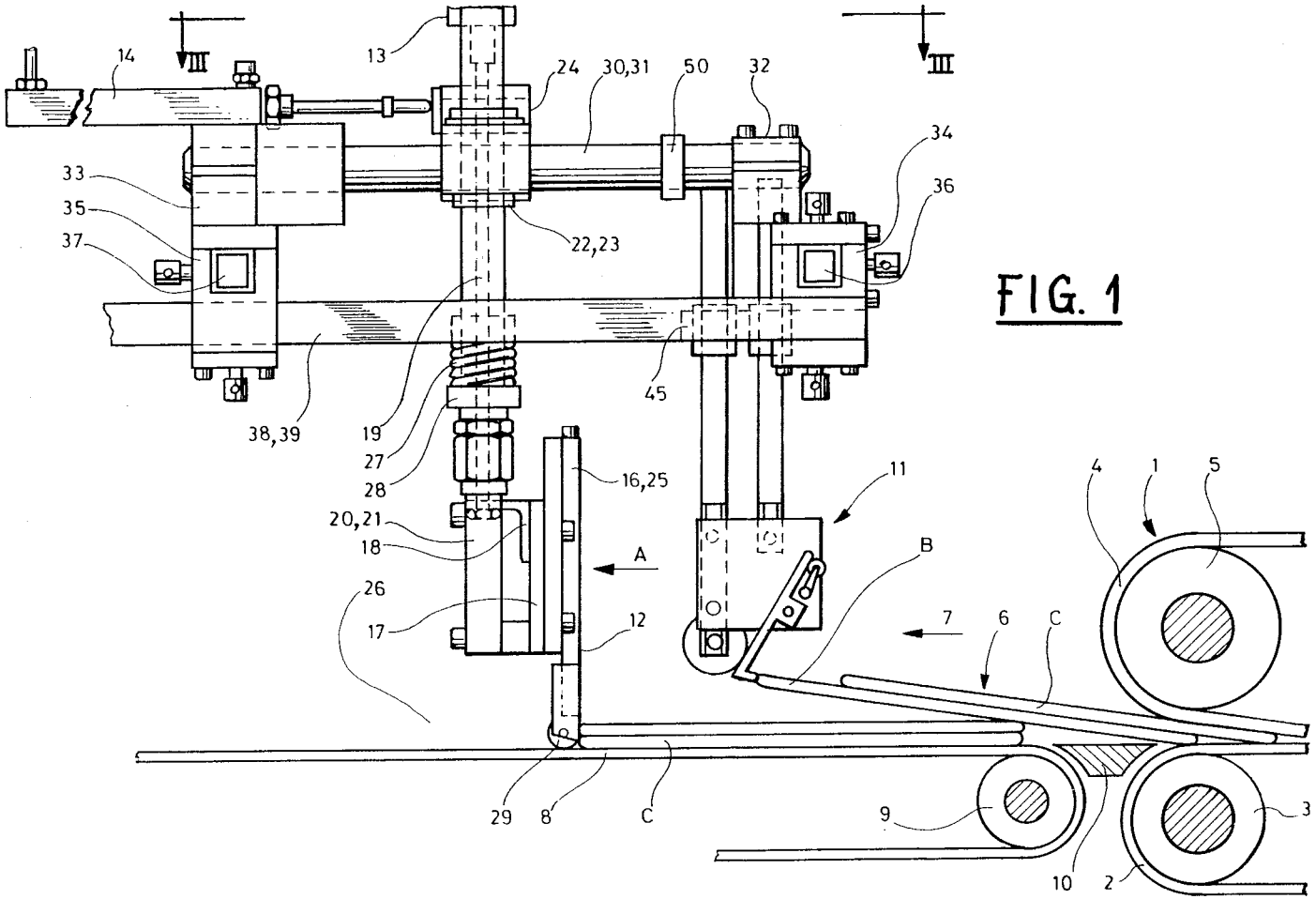
FIGS. 1, 1*a* and 1*b* are partial side views of the device of the present invention with FIG. 1 showing the accumulation of blanks into a stack, FIG. 1*a* showing the position of the stop means while passing a batch of blanks, and FIG. 1*b* showing the position of the stop while initiating the separation of next following batch.
Figure 1A:
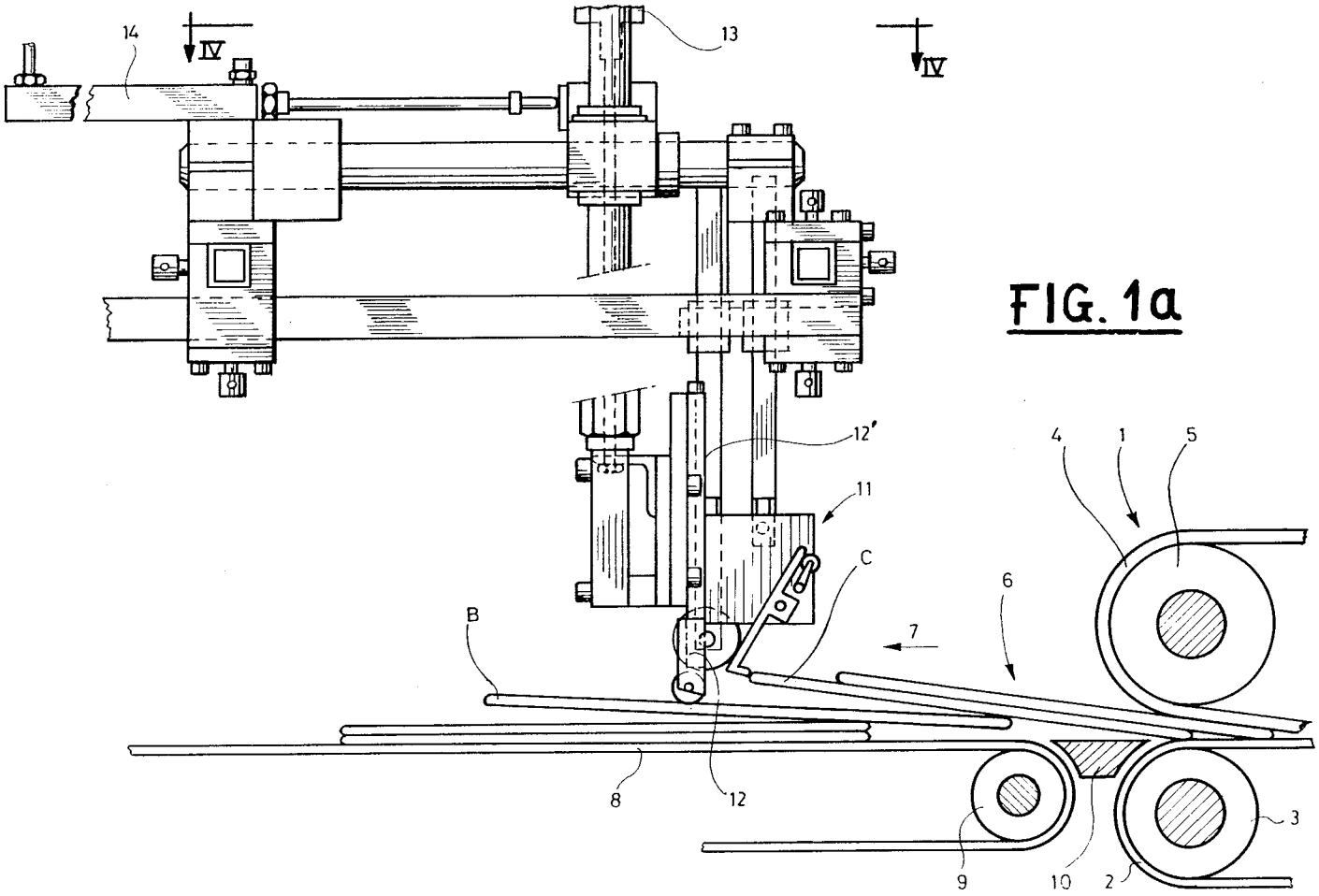
Figure 1B:
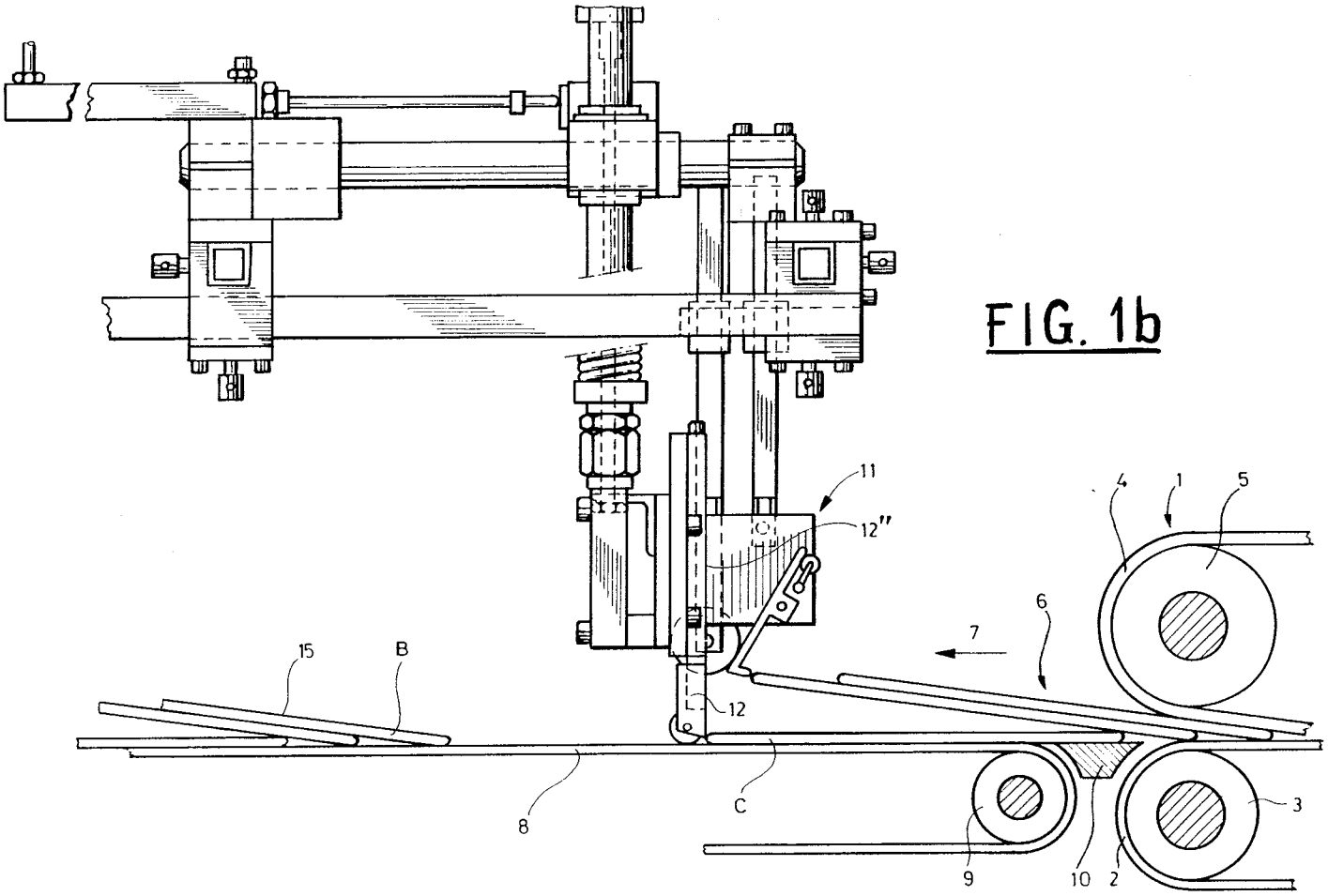

The principles of the present invention are particularly useful in a device illustrated in FIGS. 1, 1*a* and 1*b* for forming batches of folded box blanks as they are received from an output of a processing machine, such as the delivery station 1 of a folder-gluer. The delivery station 1 includes a lower belt 2 running around a lower roller or pulley 3 as well as an upper belt 4 which is on an upper roller or pulley 5. A flow of box blanks 6 is delivered by the delivery station 1 in the direction of arrow 7 onto a belt conveyor 8 which is driven by a pulley or driven roller 9. To insure a transfer between the lower belt 3 and the conveyor belt 8, a shelf 10 is provided between the two belts.

The device or apparatus of the present invention includes a counting device 11, such as described in copending U.S. patent application Ser. No. 783,175, filed Oct. 2, 1985, which issued on Dec. 15, 1987, as U.S. Pat. No. 4,713,831 and whose disclosure is incorporated by reference thereto and which application claims priority from a Swiss Pat. Application No. 4893/84 of Oct. 12, 1984. As illustrated, the counting device 11 has a pivotally mounted arm which catches a leading or front edge of a box or blank of a flow of blanks 6. The arm will pivot in a clockwise direction and trip a following roller to actuate a switch and the second roller will ride up over the leading edge of the blank to shift the counter vertically to allow passage or disengagement of the leading edge from the lever. Each time the switch is moved, it will send a pulse or signal to a conventional counter of a control device or means of the apparatus. After each blank has been counted, it is received on the belt 8 which is traveling at the same speed as the belt 2 and the blank is carried up to and against a shiftable stop 12 which will shift gradually in the direction of arrow 7 under the action of both the pressure of the blanks and the running of the belt 8. As illustrated in FIG. 1, the number of boxes to be counted, for example, three boxes have been reached and the shiftable stop 12 is then lifted by a pneumatic piston 13 from a vertical position adjacent the surface of the belt 8 to a second raised position to allow the batch to pass therebeneath. At the same time, a pneumatic piston 14 forming first means for moving shifts the plate toward a first horizontal position 12' of FIG. 1*a* which position is adjacent the counter and above a top blank B in the stack or batch. While in this first horizontal position adjacent the counter, the stop 12 rests on the top counted blank B and the next blank C will be withheld by the counting device 11. The linear speed of the belt conveyor 8 is then suddenly increased and the batch 15 of counted blanks (see FIG. 1*b*) will be separated from the flow 6 of blanks delivered by the delivery station 1. As this is done, the shiftable stop 12 then takes the position 12" of FIG. 1*b* which is with the stop 12 being in the first vertical position immediately adjacent the surface of the belt. In this position, the following box blank C rests on the belt conveyor 8 whose speed has again been lowered and the counting cycle starts again.

Figure 2:
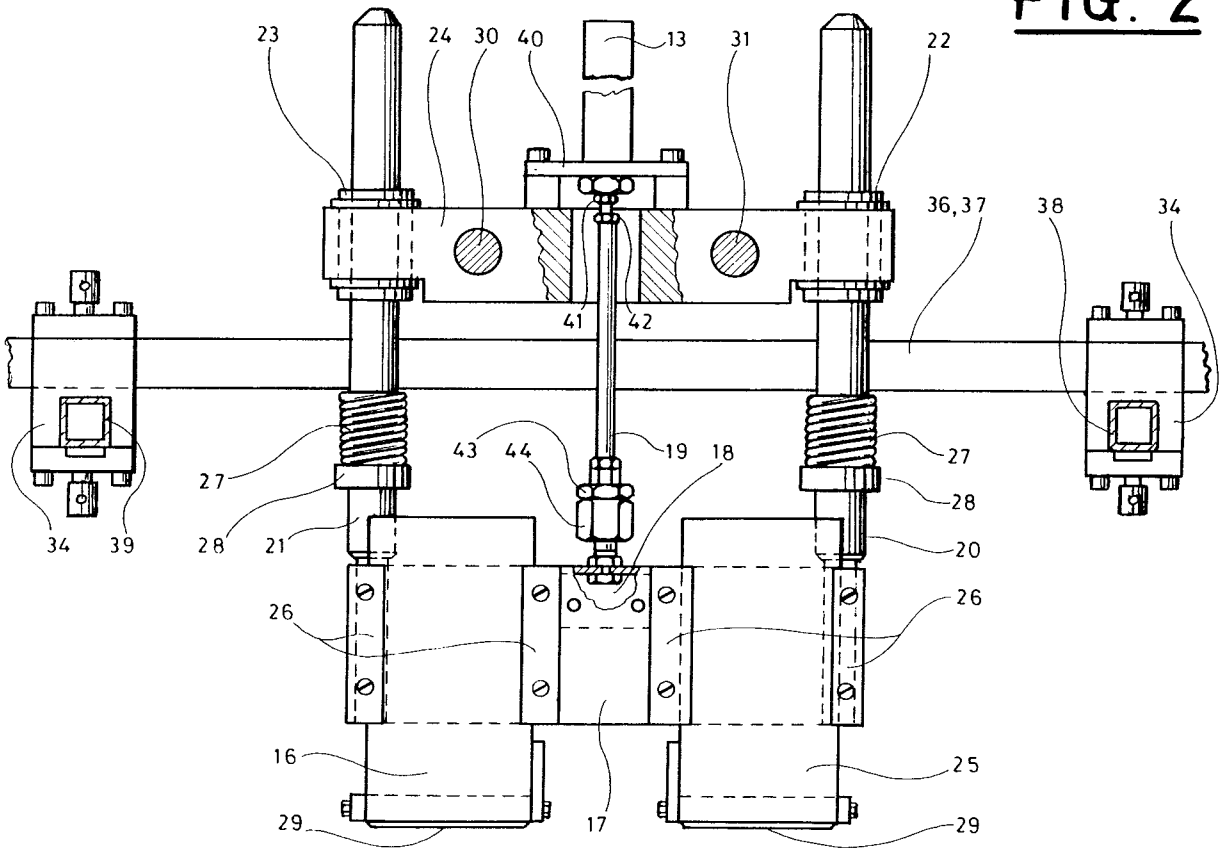
FIG. 2 is a view taken in the direction of arrow A of FIG. 1 with portions broken away for purposes of illustration.

As shown in FIG. 2, the shiftable stop 12 is made of two front walls or plates 16 and 25 which are vertically shiftable in a support or frame 17. Each wall or plate 16 and 25 is provided on its lower part with a pressure roller 28 in order to reduce as much as possible the friction of the shiftable stop 12 on the blank B during the separation. Once the height or position of the plates 16 and 25 are set relative to the surface of the belt 8, they are locked in this adjusted position by plates 26 which secure them on a frame of the support 17. The support 17 is provided with a square or plate 18 acting as a fixing piece for the end of a rod 19 of a pneumatic piston 13. The support 17 is mounted on two vertical pillars or sliding rods 20 and 21 which are slidably received in ball bearings 22 and 23 which are secured in a cross bar 24. Each of the pillars or rods 20 and 21 is equipped with a shock absorber made of a compression spring 27 located on a setting ring or shoulder 28. The cross bar 24 is slidably supported on two longitudinally extending bars 30 and 31 which are maintained at their ends by stands 32 and 33 (FIG. 1) which are mounted on supports 34 and 35 arranged on cross bars 36 and 37. The supports 34 and 35 engage supporting bars 38 and 39. The above forms a means for mounting the stop 12 for slidable movement parallel to the surface of the belt 8 and also for vertical movement perpendicular to the surface of the belt. The counting device 11 is also mounted by a cradle 45 which is secured onto the supports 34.

As illustrated in FIG. 2, the pneumatic piston 13 is also mounted on the cross bar 24 by means of a stirrup 40. The vertical positioning of the assembly is settable by a modification of the length of the rod 19 which has the nuts 41, 42, 43 and 44 which are threaded on parts of the rod.

Figure 3:
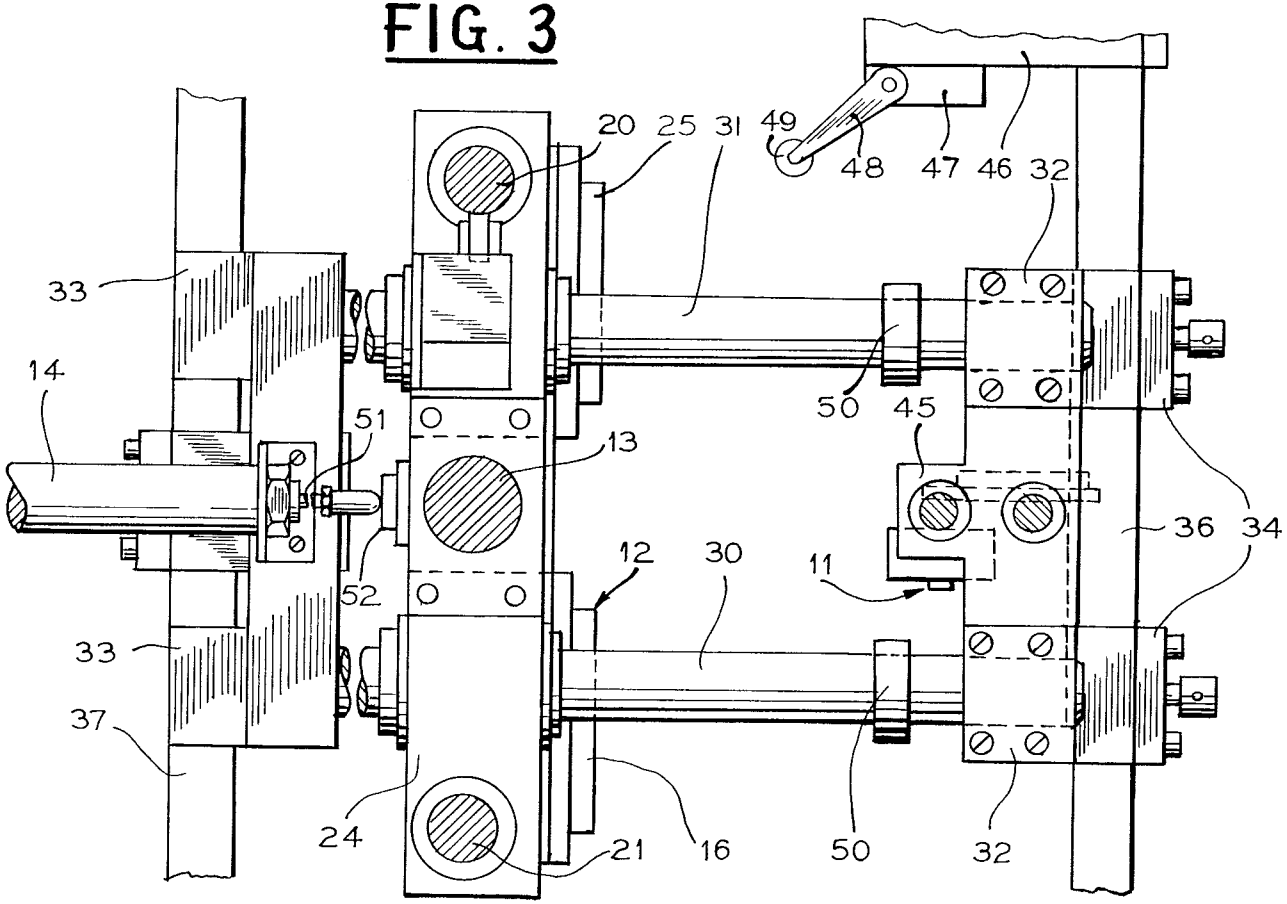
FIG. 3 is a cross sectional view taken along lines III—III of FIG. 1.
Figure 4:
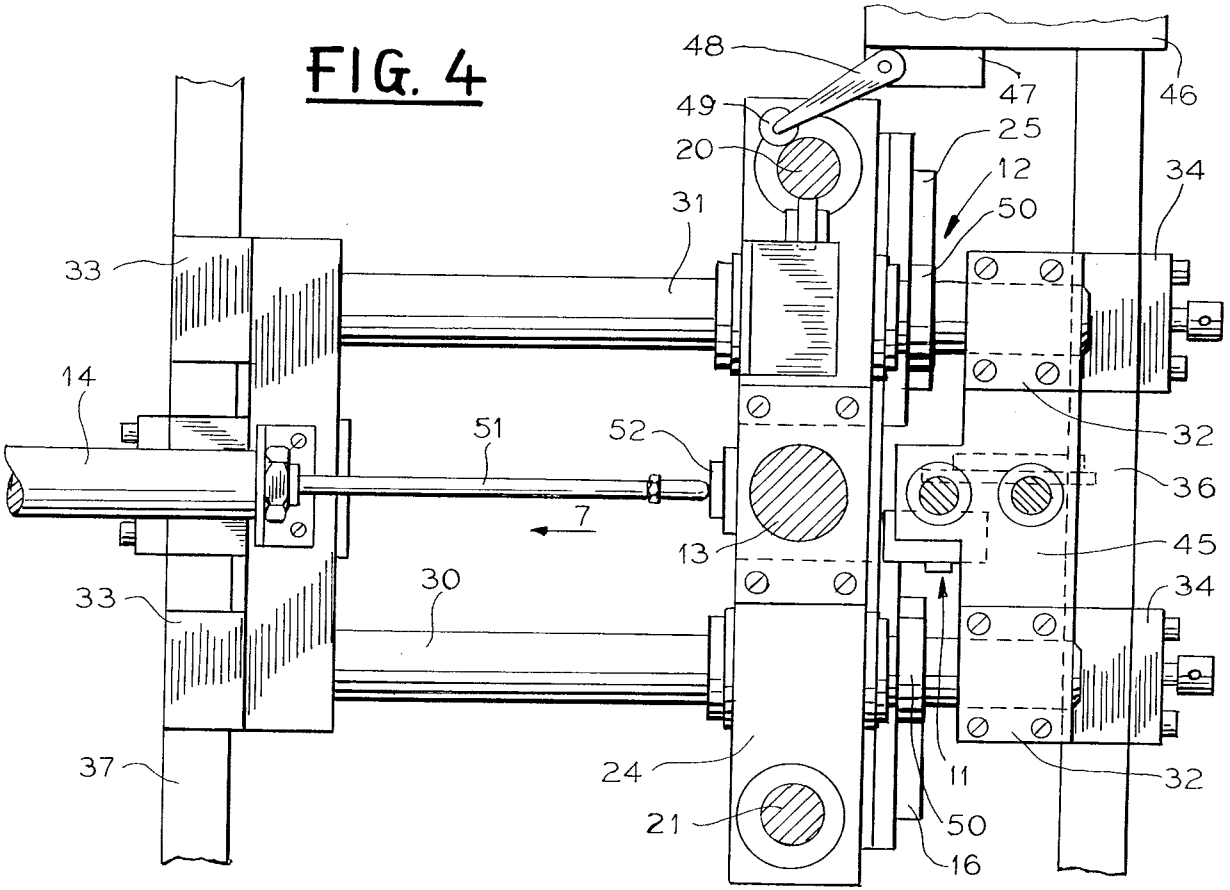
FIG. 4 is a cross sectional view taken along lines IV—IV of FIG. 1*a;*

As illustrated in FIG. 3, when the shiftable stop 12 is in a back position which is the position furthest away from the counter 11. When it is shifted to the first horizontal position adjacent the counter, the cross bar 24 will move on the rods 30 and 31 until it engages the stops 50 provided thereon. As can be seen, the cross bar 36 supports a stirrup or plate 46 which is provided with a switch 47 having a pivoting lever 48 with a roller 49. The plate 46 is mounted so that the switch will be activated when the shiftable stop is moved to the first horizontal position of FIG. 1*a* with the cross piece or bar 24 engaging the stops 50 on the slides or rods 30 and 31. As illustrated in FIG. 4, the actuation of the switch occurs from the pillar or rod 20 engaging the roller 49 as it passes thereby.

As best shown in FIGS. 3 and 4, the pneumatic actuator 14 has a rod 51 which bears against a pressure plate 52 of the cross bar 24. Thus, the actuator 14 will push the cross bar 24 and stop 12 to the first horizontal position when actuated by the control means.

As soon as the counter 11 has counted the maximum number of blanks of the batch or stack, which is three in the present instance, a relay in the control means is activated to cause the piston 14 to shift the cross piece 24 and the movable stops 12 from the position illustrated in FIG. 1 towards the position 12" of FIGS. 1*a* and 3. In addition, the control means will have the actuator 13 raise the stop 12 from the lower vertical position to an upper vertical position to allow the batch to pass therebeneath. As the cross bar 24 approaches the stops 50, the pillar 20 will engage the roller 49 of the pivot lever 48 of switch 47. The switch 47 causes a signal to the first mentioned relay to set the ports on the actuator 14 so that the stop 12 can be moved from the first horizontal position in the direction of arrow 7 against the pressure in the actuator 14. The switch 47 also activates a second relay which causes a fourth means for driving the belt at a higher speed than normal for a predetermined time to rapidly remove the batch 15 from the flow 6 of blanks, such as by carrying it off the end of the conveyor 8. After a predetermined time interval, the pneumatic cylinder 13 will lower the stop 12 to the position 12" of FIG. 1*b* and the pneumatic cylinder 14 will have its ports or valves arranged to allow the movable stop 12 to be shifted from the position 12" in the direction of the arrow 7 due to the engagement by the next following blank C on the stop and due to the friction caused by the belt.

The control means, in addition to the switch 47 with the first and second relays, includes conventional time delays which will cause the motor 53 to operate for a given period of time so that the batch 15 is removed from the belt. In addition, the control means can include conventional time delays so that the lowering of the stop can be delayed for enough time to allow the batch 15 to be clear of the stop before it is returned to the first or lower vertical position.

Figure 5:
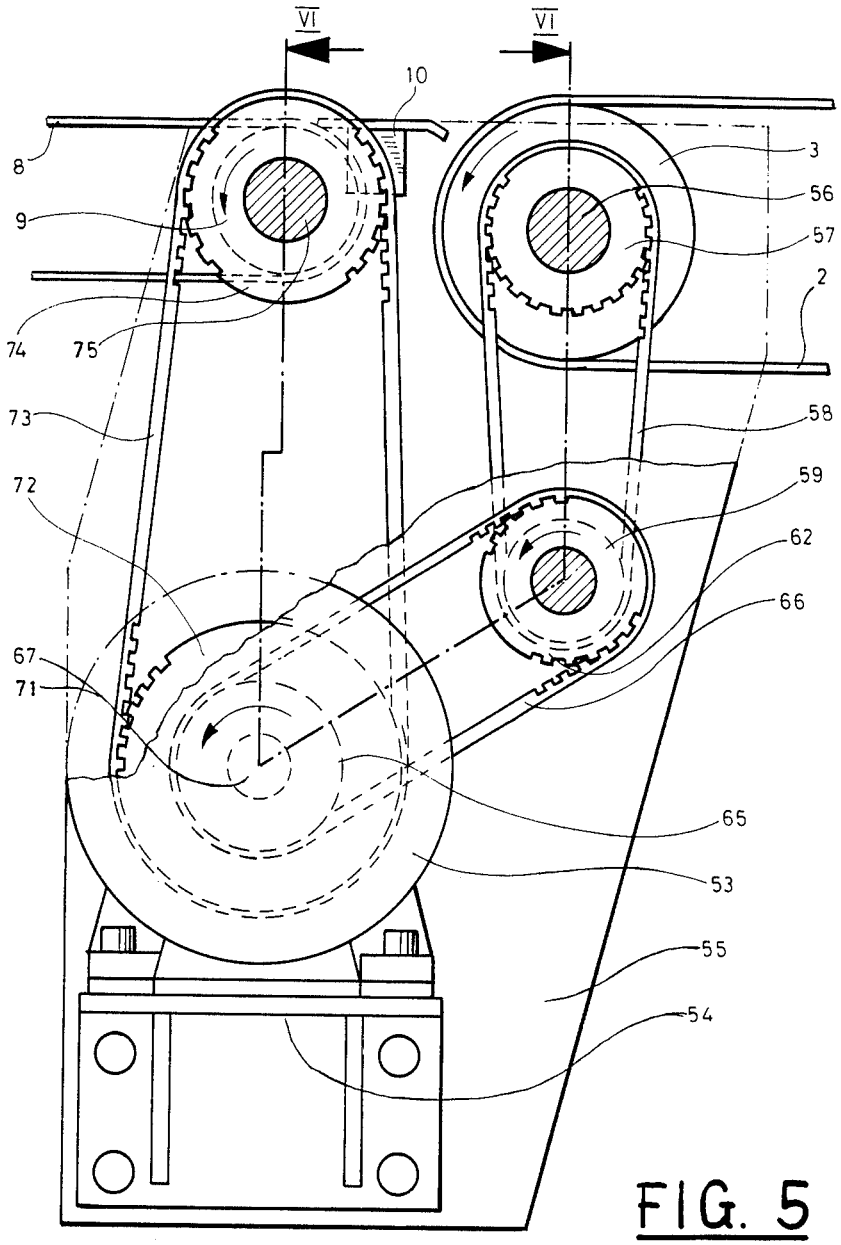
FIG. 5 is a side view with portions broken away for purposes of illustration of the drive arrangement for the conveyor of the device.
Figure 6:
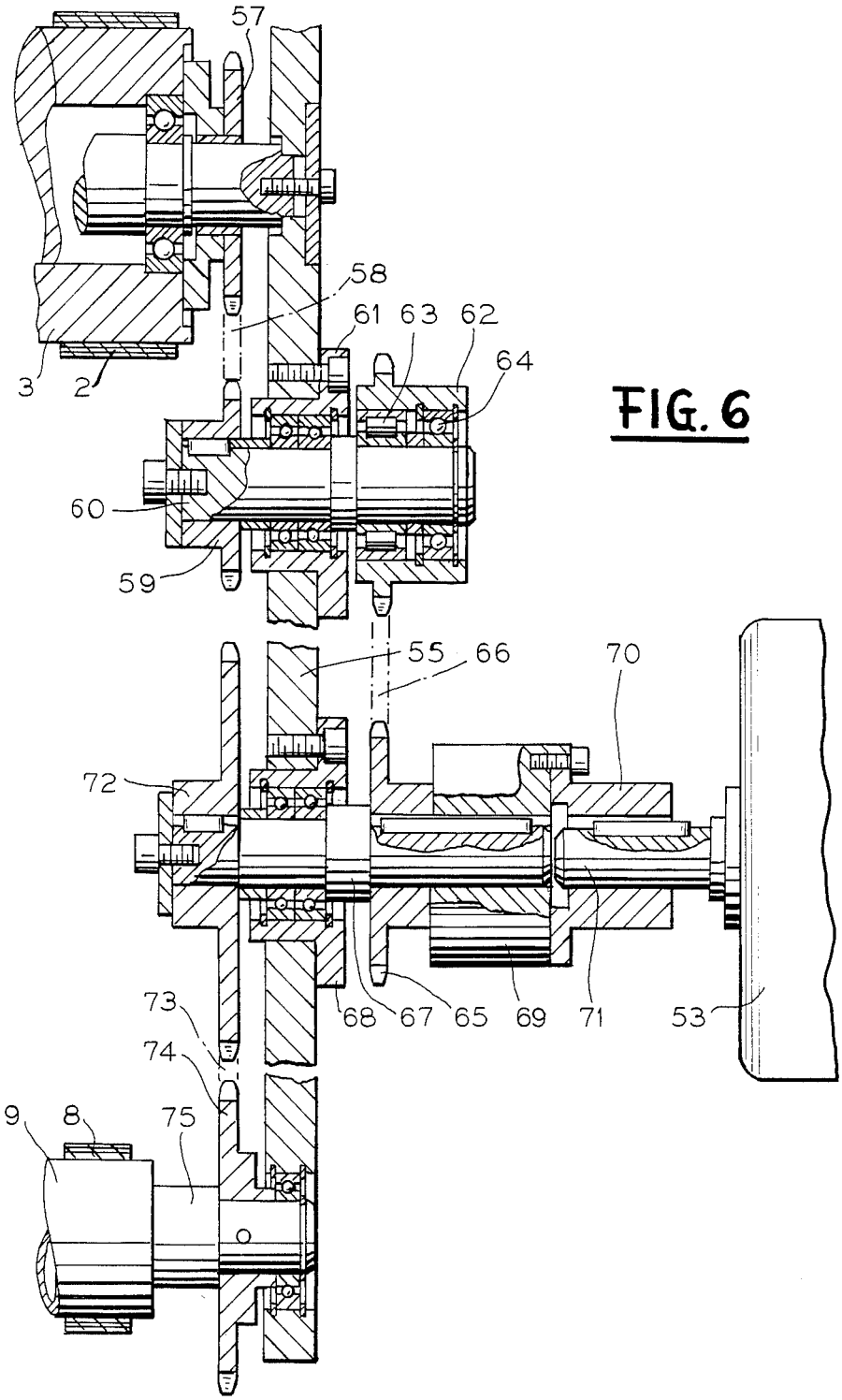
FIG. 6 is a cross sectional view taken along lines VI—VI of FIG. 5.

The roller 9 of the belt conveyor 8 is driven by third means which drives it at the same speed as the linear speed of the belt 2 of the delivery station 1 and by fourth means which drives it at a higher linear speed. The third and fourth means are illustrated in FIGS. 5 and 6. As illustrated in FIG. 5, a motor 53 is mounted on a cross piece 54 that connects the lateral frames 55 for the device. The motor 53 is only set into operation when the second relay has been actuated. The low speed driving of the belt conveyor 8 is achieved by the rotating of the drive roller 3 of the lower belt 2. A tooth wheel or gear 57 is keyed to a shaft 56 of the roller 3 and is engaged by a chain or a tooth drive belt 58. The tooth drive belt goes to a pinion gear 59 which is keyed on a shaft 60 which is mounted in a lateral frame member 55 by a roller bearing arrangement 61. The shaft or axle 60 also includes another pinion 62, which is mounted on the axle by a uni-directional coupler 63 and a ball bearing 64. The pinion 62 is connected to a tooth gear 65 by a chain or a toothed belt 66. The gear 65 is keyed onto a shaft 67 which is held in a bearing with ball bearings 68 against a frame 55 and the shaft 67 also contains a second uni-directional coupler 69 which is secured on the shaft and also is secured to a bushing 70 which is keyed to a shaft 71 of the motor 53. The shaft 67 opposite to the motor 53 is keyed to a toothed-gear 72 and this gear is connected by means of a chain or notch belt 73 to a pinion 74 which is keyed on a shaft 75 of the driven roller 9 for the conveyor belt 8.

In the above mentioned arrangement, the third means for driving the belt 8 at the same linear speed as the belt 2 comprises the gear 58 driving the pinion 59 through the belt 58 which, in turn, drives the gear 62 to the one way uni-directional clutch 63 to drive the gear 65 via the belt 66. The gear 65 will thus rotate the shaft 67 as well as the gear 72 which, in turn, will drive the gear 74 by the belt or chain 73. The uni-directional coupling or clutch 69 will prevent rotation of the motor shaft 71 since it will not transfer motion in this direction from the shaft 67. When the fourth means which comprises the motor 53, the coupling or sleeve 70 and the uni-directional clutch or coupling 69 is actuated, the shaft 67 will be driven by the motor shaft 71 because of the transfer of the rotary motion by the coupler 69. This, in turn, will drive the gear 72, the belt 73 and the gear 74. In addition, the belt 76 will be rotating the gear 62 but because of the one way clutch 63, this rotation will not be transferred to the shaft 60. Thus, when the motor 53 is actuated, it will drive the belt 58 at a much higher linear speed to remove the batch without effecting the rate of advancement of the flow 6 of blanks into the device.

The operator thus has a secure device for the automatic separation of batch of folded box blanks which are counted with accuracy. One advantage of this device is that the separation of the flow of folded box blanks is done without changing the plane of the box blanks arriving into the device.

Although various minor modifications may be suggested by those versed in the art, it should be understood that we wish to embody with the scope of the patent granted hereon, all such modifications as reasonably and properly come within the scope of our contribution to the art.

We claim:

1. In a device for forming separate batches of flat objects, particularly for forming batches of folded box blanks being delivered in a flow from a processing machine, said device including a belt conveyor being arranged to receive a discharge from a delivery station of the processing machine, counting means for determining the number of blanks passing therebeneath in the flow of blanks, separating means for removing a batch of counted blanks from the flow of blanks and control means for actuating the separating means, the improvements comprising the separating means including a stop, means mounting the stop adjacent the surface of the conveyor belt for both movement parallel to the surface of the belt and perpendicular to said surface, first means for moving the stop towards a first horizontal position adjacent the counting means, second means for moving the stop between a first vertical position adjacent the surface of the belt to a second vertical position raised above the surface of the belt to allow passage of a batch of blanks therebeneath, third means for driving the conveyor belt at a linear speed of discharge for the processing machine, fourth means for driving the belt at a speed greater than the linear speed of the discharge of the processing machine and said control means including switch means being engaged when the stop is moved to the first horizontal position, said switch means actuating the fourth means to accelerate the speed of the belt to rapidly remove a batch from beneath the stop for a predetermined time interval.

2. In a device according to claim 1, wherein the stop comprises a frame, two front plates, means adjustably mounting the front plates on the frame, each of said front plates having a pressure roller adjacent a lower edge.

3. In a device according to claim 1, wherein the third means comprising a drive train connecting a driven roller of a delivery station for the processing machine to a drive roller of the belt conveyor of the device.

4. In a device according to claim 3, wherein said drive train includes a plurality of gears and tooth belts, one of said gears being mounted to a shaft by a first uni-directional coupling and the fourth means includes a motor and a drive train connecting the motor to said driven roller and to said shaft by a second uni-directional coupling so that when the fourth means is in operation, the first uni-directional coupling does not transmit rotation of a motor of the fourth means to the drive roller of the delivering station.

5. In a device according to claim 1, wherein the control means includes a first relay actuated by the counting means, said first relay actuating the first means to shift the stop to the first horizontal position and the second means to shift the stop from the first to the second vertical position.

6. In a device according to claim 1, wherein the fourth means has a motor, and said switch actuates both a first and second relay, said first relay set the first means to allow the stop to be moved from said first horizontal position, said second relay is actuated for a given length of time to actuate said motor, said second relay actuating a time delay to cause said second means to move the stop from the second raised vertical position to the first vertical position.

7. In a device according to claim 1, wherein the means for mounting comprises a cross bar receiving two vertically extending rods for sliding movement in bearings, said cross bar being mounted on two horizontally extending rods for slidable movement parallel to the belt, said first means including a pneumatic piston having a piston rod engaging the cross bar, the second means comprising a pneumatic piston mounted on the cross bar and connected to a frame of said stop.

* * * * *